United States Patent [19]

Lange

[11] 4,211,068

[45] Jul. 8, 1980

[54] CHAIN WELDING MACHINE

[75] Inventor: Gerhard Lange, Reutlingen, Fed. Rep. of Germany

[73] Assignee: Wafios, Maschinenfabrik, Wagner, Ficker & Schmid (GmbH & Co. KG), Reutlingen, Fed. Rep. of Germany

[21] Appl. No.: 971,098

[22] Filed: Dec. 19, 1978

[30] Foreign Application Priority Data

Dec. 27, 1977 [DE] Fed. Rep. of Germany ..... 2758243

[51] Int. Cl.[2] ..... B21L 3/02

[52] U.S. Cl. ..... 59/31; 219/51

[58] Field of Search ..... 59/31, 33, 34, 35; 219/51, 52

[56] References Cited

U.S. PATENT DOCUMENTS

| | | | |
|---|---|---|---|
| 2,288,494 | 6/1942 | Speed | 219/51 |
| 3,350,533 | 10/1967 | Kleine | 219/51 |
| 3,551,633 | 12/1970 | Wattler | 219/51 |
| 3,906,183 | 9/1975 | Lange | 219/51 |

FOREIGN PATENT DOCUMENTS

| | | | |
|---|---|---|---|
| 2457180 | 10/1976 | Fed. Rep. of Germany | 219/51 |
| 2036244 | 12/1970 | France | 59/31 |
| 1460365 | 1/1977 | United Kingdom | 59/31 |

*Primary Examiner*—Francis S. Husar
*Assistant Examiner*—Gene P. Crosby
*Attorney, Agent, or Firm*—Thomas R. Morrison

[57] ABSTRACT

A chain welding machine has a first cam-operated linkage for rapidly moving upsetting dies into and away from the ends of a link to be welded and a second hydromechanical linkage for applying upsetting force to the ends of the link. The upsetting force is controlled by hydraulic pressure which is regulated as a function of time by a cam-controlled pressure-limiting valve.

12 Claims, 4 Drawing Figures

CHAIN WELDING MACHINE

BACKGROUND

In a chain welding machine of this type known from German published unexamined patent application 2,457,180, the kinematic chain of elements begin at a nonpositive cam mechanism with a camshaft-mounted disk cam which actuates the control lever. A hydraulic cylinder serving as a link of the kinematic chain of elements is disposed between two other, adjacent links of this chain and connected to both. As a result, the contact pressure exerted on each other by the two wire ends of the chain link to be welded is nearly constant from one link to the next regardless of the tolerances in the dimensions and strength values of the links of a given chain strand, and the weld quality therefore remains constant.

This is accomplished also with the chain welding machine proposed in patent application P 26 45 719.2-14 of the Applicant, which corresponds to U.S. patent application Ser. No. 839,391, now U.S. Pat. No. 4,139,982, which moreover requires less maintenance and reliably maintains a predetermined contact pressure. In this machine, which has no accumulator and has a single-acting hydraulic cylinder, the supply line to the latter is interrupted by a safety relief valve and a pressure-regulating valve and is connected to a hydraulic pump moving a hydraulic fluid.

However, both the prior-art machine and the machine proposed by the Applicant are unable, because of the non-positive connection at the cam mechanism produced by springs at least in the machine proposed by the Applicant, to permit a definite, reproducible adjustment of the contact pressure with time as a function of the changing normal dimensions, shapes and materials of the links of different chain strands that would vary from one chain strand to the next. Hitherto this has been possible only with fully hydraulic machines, which are considerably more complicated with respect to construction and control than the essentially mechanical machines of the type to which the invention relates.

SUMMARY

Thus the invention has as its object to provide a chain welding machine of the type mentioned above which accurately reproduces from one link to the next a variation with time, determinable as desired for each strand, of the reciprocal contact pressure of the two wire ends of the chain link to be welded together. "As desired" is an important characteristic since in hydraulic chain welding machines the contact pressure can only be varied in steps.

In accordance with the invention, this object is accomplished in a chain welding machine of the type mentioned above, which has a pressure-regulating valve in the supply line, in that the hydraulic cylinder actuates the control lever and that the pressure-regulating valve is provided with preliminary control through a pressure-limiting valve adapted to be mechanically actuated by a feeler roller which rolls along a disk cam mounted on the cam shaft. Obviously this disk cam has nothing in common with the disk cam of a conventional spring-loaded, and therefore nonpositive, cam mechanism.

The disk cam in accordance with the invention may readily be adapted to the dimensions, shape and material of the links of any chain strand. The feeler roller rides along the disk cam, thus mechanically actuating the pressure-limiting valve which precontrols the pressure-regulating valve so that the hydraulic cylinder engages the control lever at all times with a force independent of its stroke, with the result that the variation with time of the contact pressure in the chain link to be welded is precisely determined. Moreover, the hydraulic system of the chain welding machine in accordance with the invention provides compensation for variations in the dimensional stability and accuracy of shape of the chain links of an unwelded chain strand due to bending errors and tolerances in the dimensions and strength values, an object which the earlier proposal also sought to accomplish, and does so independently of the variation of the chosen contact pressure with time or, in the final analysis, of the profile of the disk cam. Said profile may advantageously be selected so that the contact pressure with which the wire ends to be welded together are initially abutted and finally pushed up against each other, which is known as the upsetting pressure, at first is relatively high, then drops and in the end rises to a high level for the upsetting of the plasticized metal. Since the ohmic resistance is a function of contact pressure, this variation of the pressure with time results in a similar but inverse variation of the temperature, which is most favorable as an overheating of the chain-link metal at the start will lead to a spattering of plasticized metal.

The mechanical control of the contact pressure in accordance with the invention thus also has the advantages of the measures proposed earlier by the Applicant whereby the chain welding machine proposed earlier differs from the chain welding machine known from German patent No. 2,457,180.

In a preferred embodiment of the chain welding machine in accordance with the invention, whose hydraulic cylinder is single-acting, as in the machine proposed earlier, the hydraulic cylinder is jointed on the one hand to the machine frame and on the other hand to a jointing arm of the control lever, a roller being mounted on said jointing arm of the control lever and a disk cam being mounted on the cam shaft, said disk cam cooperating with the roller during a fraction of the time of a single revolution of the cam shaft. The arrangement of roller and disk cam replaces the reaction of the hydraulic cylinder, which is merely single-acting, and may be dispensed with if the latter is double-acting. This, however, would entail the drawback of greater control complexity for the hydraulic cylinder.

In the preferred embodiment the pressure-regulating valve is provided with a bypass line containing a bypass check valve which allows the hydraulic liquid to return from the hydraulic cylinder to the accumulator. Provision for this must be made in any event.

In the preferred embodiment, whose supply line contains a safety relief valve, as provided for in the machine proposed earlier, and is connected to a hydraulic pump moving a hydraulic liquid, the supply line is forked ahead of the pressure-regulating valve and has two branch lines, one of which is connected to the accumulator and the other to the safety relief valve. This makes for a simple circuit.

In the preferred embodiment, there is further connected in parallel with the series-connected hydraulic pump and safety relief valve a safety pressure-limiting valve which opens when the hydraulic pressure in the supply line between the pressure-regulating valve, the accumulator and the safety relief valve becomes too high since the hydraulic pump, which is best driven by an electric motor, and which replaces the leakage losses of displacement oil and circulating oil from a storage tank, works continuously.

Finally, the preferred embodiment is further distinguished by the fact that the disk cam sensed by the feeler roller is replaceably mounted on the cam shaft. Assurance is thus provided by the simplest means that the machine can be adapted to the various chain links handled. The profile of the disk cam is determined empirically, a recorder recording the variation of pressure and current with time, and data being derived from the record for the correction of an unworked part. In place of hydraulic system parts of the machine operated by means of a hydraulic liquid, technically equivalent pneumatic system parts operated by a hydraulic gas may be used if the compressibility of the gas is not a factor.

DESCRIPTION OF THE DRAWINGS

The invention is explained below in detail in terms of the preferred embodiment of the chain welding machine in accordance with the invention, shown by way of example in the drawing, where.

DETAILED DESCRIPTION OF THE PREFERRED EMBODIMENT

Figure 1:
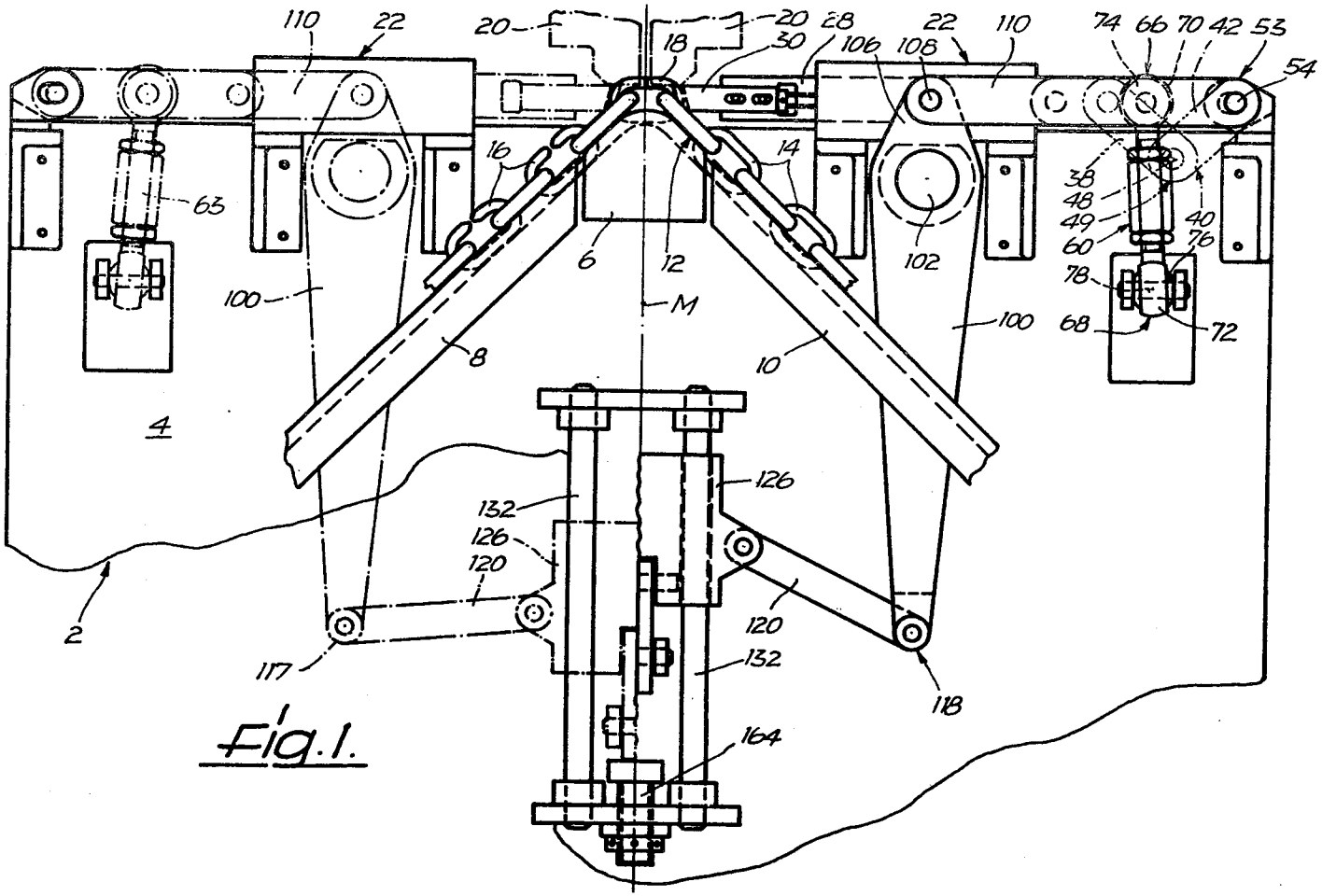
FIG. 1 is a front elevation of the embodiment which because of the symmetrical construction is shown incomplete and in part schematically.

The embodiment is substantially symmetrical relative to the central plane M in FIG. 1. To the extent that it is symmetrical, the description thus relates to only one half of the machine. However, it applies to its other half as well.

A frame 2 of the machine has a vertical front plate 4 in front of whose upper edge there is a stationary saddle 6 disposed symmetrically to the central plane M and to a guide plane that is perpendicular to said central plane, said saddle being flanked on both sides of the central plane M by guide rails 8 and 10, inclined about 45° to the vertical and to the horizontal, for the feeding and discharge of a chain strand 12 having a number of already welded chain links 14 and of chain links 16 to be welded. A conveying means (not shown) is provided for advancing the chain strand 12 by two chain links after the horizontal upper wire ends of the chain link 18 located in the guide plane on the saddle 6 have been welded together by means of two welding electrodes 20, so that after every advance the next chain link to be welded is in the welding position described.

Outside of the central plane M, there is disposed above each rail at the level of the chain link 18 a horizontal, straight guide 22 which receives a die holder 28. At its front end adjacent to the central plane M, each die holder 28 is provided with an upsetting die 30 which is mounted so as to be movable in the axial direction and which by its appropriately shaped front end engages the directly adjacent rounded portion of the chain link 18 when the die holder 28 has completed a quick-traverse forward stroke, which is followed by the abutting and upsetting stroke. Jointed to the rear end of the die holder 28 which is remote from the upsetting die 30 is the first leg 38 of a first knee lever 40 which is adapted to be flexed and extended and whose second leg 42 forms a knee joint 49 with the first leg 38, and which by its end remote from the knee joint is movably mounted on the front plate 4 by means of a swivel and sliding joint 53.

Figure 2:
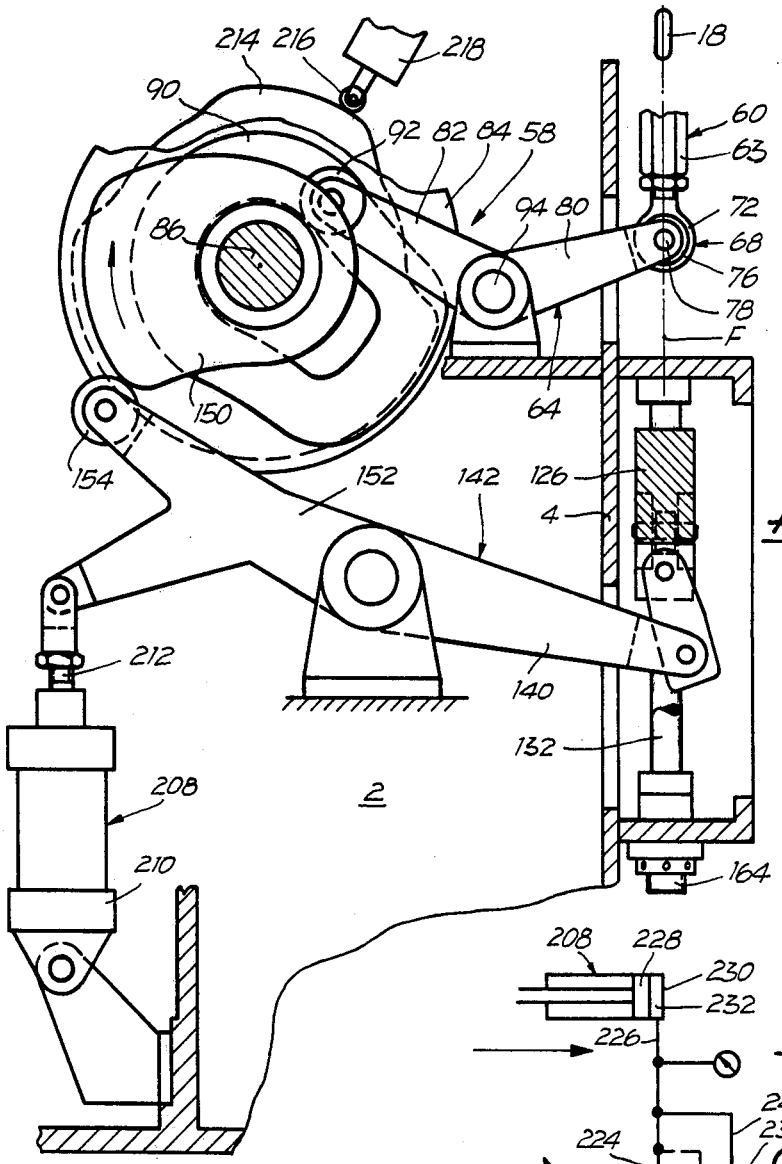
FIG. 2 is an incomplete and partly schematic side elevation of the embodiment.

A connecting rod 60 which couples the first knee lever 40 to a positive cam mechanism 58 shown in FIG. 2, and which lies substantially in the guide plane, engages the bolt 48 of the knee joint 49. The connecting rod 60 is of two-part construction, the parts being connected to each other by a turnbuckle 63. They are connected through articulated couplings with the knee joint 49 and one lever 64 of the cam mechanism 58. The articulated couplings are rod-head ball-and-socket joints 66 and 68 whose heads 70 and 72 are disposed at the ends of the connecting rod 60 and whose ball parts 74 and 76 are seated on the bolt 48 of the knee joint 49 or on a bolt 78, respectively, which is fastened to the free arm 80 of the lever 64 of the cam mechanism 58. The positive-motion arm 82 of the lever 64 is positively controlled by a disk cam 84 of the cam mechanism 58 which is mounted on a continuously revolving cam shaft 86 that is rotatably mounted on the frame 2 and is provided with a drive (not shown). The disk cam 84 has an endless groove 90, as is apparent from FIG. 2, which encircles the cam shaft 86 and along whose opposed edges a roller 92 rotatably mounted on the positive-motion arm 82 of the lever 64 rolls. The lever 64 is pivoted on a bolt 94 disposed on the frame 2 parallel to the front plate 4.

The embodiment is provided on each side of the central plane M with an upsetting lever 100 which is adapted to execute a limited rotational movement about an axis perpendicular to the guide plane on a bolt 102 fixed to the frame 2. Each upsetting lever 100 has two uniform flat portions, each of which has a short arm and a long arm, the short arms 106 being disposed on opposite sides of the guide 22 and being jointed by means of a bolt 108 to a flat bar 110 which is disposed substantially parallel to the guide direction of the die holders 28, and whose end remote from the associated short arm 106 is seated on a pin 54 of the swivel and sliding joint 53. Each upsetting lever 100 forms the first leg of a second knee lever 118 which has only a passive knee joint 117 and whose second leg is a lever 120. The lever 120 is jointed by its end remote from the knee joint 117 to a slide 126 common to both machine halves. The slide 126 is guided on two parallel rods 132 which are disposed in the guide plane and are attached to the frame 2. To fix the final minimum spacing of the upsetting dies 30, a captive setscrew 164 is provided whose head forms an indirect stop for the slide 126 when the latter is in its lowermost position, which results in a knee angle of the second knee levers 118 of less than 90°. The slide 126 is coupled to the free arm 140 of a control lever 142 which is pivoted to the frame 2 parallel to the central plane M.

The control lever 142 is part of a common drive mechanism for the two upsetting levers 100. The drive mechanism comprises a disk cam 150 which is mounted on the cam shaft 86 and cooperates with a roller 154 mounted on the forked positive-motion arm 152 of the control lever 142 and rolling intermittently along the periphery of said cam, thus temporarily swinging back the control lever 142. The force acting upon the arm 152 of the control lever 142 is supplied by a hydraulic cylinder 208. The cylinder 210 and the piston rod 212 of the single-acting hydraulic cylinder 208 are jointed by means of a bearing fixed to the frame and of a bolt to the frame 2, and by means of a fork and of a bolt to the arm 152 of the control lever 142. The extension of the piston rod 212 for the swinging motion of the control lever 142 is brought about by means of a hydraulic liquid such as hydraulic oil supplied to the hydraulic cylinder 208 so long as the roller 154 is not rolling along the periphery of the disk cam 150. The piston rod 212 is caused to retract, and the control lever 142 to swing back, by the disk cam 150, which radially removes the roller 154 from the cam shaft 86, thus rotating the arm 152 about the axis of rotation of the control lever 142. In the embodiment the disk cam 150 has approximately the shape of a tangential cam; however, its two nearly straight sides are slightly curved concavely and convexly, respectively, in order that the revolving disk cam 150 may rapidly lift off the roller 154 or gently make contact with it. The two circular arcs of the disk cam 150 are concentric with the axis of the cam shaft 86.

Mounted on the cam shaft 86 is, in addition to the disk cam 84 of the cam mechanism 58, a disk cam 214 along whose profiled periphery, which determines the desired variation with time of the abutting and upsetting stroke of the upsetting dies 30, and hence the contact pressure which the wire ends of the chain link 18 to be welded together exert on each other, a feeler roller 216 which mechanically actuates a pressure-limiting valve 218 of a hydraulic system of the embodiment.

Figure 3:
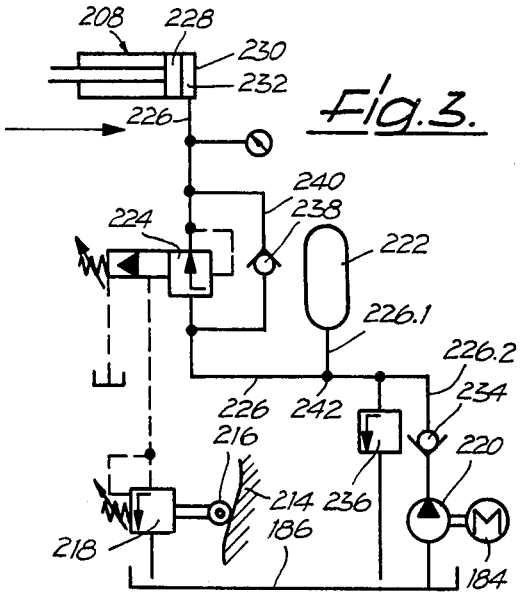
FIG. 3 is a schematic representation of a portion of the hydraulic system of the embodiment.

As shown in FIG. 3, the hydraulic system of the embodiment consists essentially of a hydraulic pump in the form of a constant-displacement pump 220 with nonreversible direction of flow which is adapted to be driven by an electric motor 184. The pump 220 draws hydraulic liquid from a vented tank 186 through a line terminating below the liquid level. A hydropneumatic accumulator 222, with or without baffle, is connected to supply line 226 via first branch 226.1. A pressure-reducing pressure-regulating valve 224 with preliminary control through the pressure-limiting valve 218 which, as pointed out, is mechanically actuated by the feeler roller 216 is connected to the tank 186 through a line terminating above the liquid level of said tank. The supply line 226 is interrupted by the pressure-regulating valve 224 and discharges into the hollow space 232 with variable operating volume located between the piston 228 of the hydraulic cylinder 208 and its bottom 230. A second branch line 226.2 is interrupted by a safety relief valve 234 and terminates at the constant-displacement pump 220. A safety pressure-limiting valve 236 is located in parallel with the series-connected constant-displacement pump 220 and safety relief valve 234 and thus connects the branch line 226.2 to the tank 186 through a line terminating above the liquid level of said tank. A bypass check valve 238 interrupts a bypass line 240 which branches off the supply line 226 between the hydraulic cylinder 208 and the pressure-regulating valve 224 on the one hand and between the latter and the fork 242 in the supply line 226, thereby bypassing the pressure-regulating valve 224. As shown symbolically in FIG. 3, the feeler roller 216 works against a variable restoring force acting upon the pressure-limiting valve 218. The pressure-regulating valve 224 undergoes pressure relief through the pressure-limiting valve 218 acting as a preliminary-control valve.

The principle of operation of the embodiment described is as follows: At the start of the forward stroke of the two upsetting dies 30 the two first knee levers 40 are flexed so that their two legs 38 and 42 assume the position indicated in FIG. 1 on the right by dash-dotted lines. For actuation of the knee joints 49, the positive cam mechanism 58 now causes the very rapid extension of the two first knee levers 40, with their legs 38 and 42 then assuming the positions indicated in FIG. 1 on the left by dash-dotted lines. When both knee levers 40 have been brought into the extended position by a rapid-traverse motion, the two upsetting dies 30, which may be replaced and adjusted on the basis of the standard dimensions of the chain link to be welded, abut on the rounded portions of the chain link 18. While the upsetting dies 30 are executing the forward stroke, the hydraulic cylinder 208 is in its initial and rest position as shown in FIG. 2 without, however, being operational since the cam 150 and the roller 154 are blocking the swinging movement of the control lever 142. At the start of the abutting stroke of the upsetting dies 30, which coincides with the end of the forward stroke when the dies bear on the rounded portions of the chain link but exert no upsetting pressure, and when the slide 126 is in its upper reversing position (see right half of FIG. 1) in which it is held by the cam 150 and the roller 154, the air gap between the wire ends of the chain link 18 is not closed and the disk cam 150 starts to rapidly lift off the roller 154, revolving its lagging concave side fully under the roller 154. The abutting stroke of the upsetting dies 30 which follows serves to eliminate the gap and is brought about by the operation of the hydraulic cylinder 208, with the knee levers 40 extended, by virtue of the two open kinematic chains 142-126-118-110-40-28. The hollow space 232 of said cylinder is supplied with hydraulic liquid from the accumulator 222 through the supply line 226 until the hydraulic liquid accumulating in the space 232 attains an inside pressure which is exactly equal to the outlet pressure set at the pressure-regulating valve 224 by the preliminary-control pressure-limiting valve 218. At the end of the abutting stroke, which coincides with the start of the actual upsetting stroke, the slide 126, the two second knee levers 118, the flat bars 110, the two extended first knee levers 40, the two die holders 28, the two upsetting dies 30 and the chain link 18 form a closed kinematic chain with variable flow of force in which by means of the hydraulic cylinder 208 and the control lever 142 a variable external force is initiated through the descending slide 126. At the end of the abutting stroke, the welding electrodes bear on the wire ends of the chain link 18 which are to be welded together. Now the welding current is switched on and the upsetting dies gradually press harder against the chain link 18. After the welding current has flowed for a minimum of time so that the welding temperature has been reached, the final phase of the welding process begins, which due to the softening of the wire metal is accompanied by the final upsetting process. After the electrodes 20 have been retracted and the enlarged weld area has been shaved smooth by means of tools not shown, hydraulic liquid is returned through the bypass check valve 238 in that hydraulic liquid is forced out of the space 232 and back into the accumulator 222. The return flow of the hydraulic liquid is brought about by the movement of the piston 228 of the hydraulic cylinder 208 toward the cylinder bottom 230 under the influence of a force which seeks to shorten the aggregate. This force is generated solely by the leading convex side of the disk cam 150. The knee levers 40, still extended, which provide for the flow of force from the upsetting levers 100 to the upsetting dies 30 are then again flexed by their positive cam mechanisms 58 so that the upsetting dies execute their return stroke in rapid-traverse motion and then are sufficiently spaced from the chain link 18 to permit the unhindered advance of the chain strand 12. The cycle can now be repeated.

The disk cam 214 which is replaceably mounted on the cam shaft 86 limits the inlet pressure at the pressure-limiting valve 218 in that it opens the valve outlet to the tank 186 to a greater or lesser degree. The limited inlet pressure is also the preliminary-control pressure for the pressure-regulating valve 224, whose more or less high outlet pressure is maintained substantially constant even though the inlet pressure supplied mainly by the accumulator 222 is in any case higher than the maximum pressure and, moreover, is variable. The constant-displacement pump 220 merely replaces the leakage losses of hydraulic liquid which occur as the latter is displaced between the hydraulic cylinder 208 and the accumulator 222 and as the pressure-limiting valve 218 is actuated. The pressure-limiting valve 236 and the relief valve 234 are provided for safety reasons to neutralize pressure surges and particularly to protect the hydraulic pump.

Figure 4:
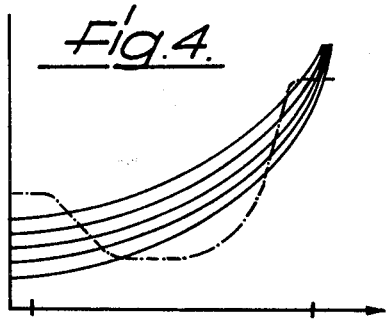
FIG. 4 is a diagram plotting the upsetting force exerted by the upsetting dies of the embodiment upon the chain link to be welded as a function of the upset travel of the upsetting dies for the embodiment (dash-dotted curve) and for the chain welding machine known from the Applicant's published examined German patent application 2,317,691 (family of solid curves), the parameter of the family of curves being the initial tension of a spring battery.

FIG. 4 plots, by way of example, the path- and/or time-dependent variation which may be desired of the up-setting force or the contact pressure with which the wire ends of the chain link to be welded together abut on each other. A moderate force during the abutting stroke and the initial phase of the upsetting stroke of the upsetting dies is followed first by a lower force during the middle phase of the upsetting stroke with a steep heat rise, then by a higher force during the final phase of the upsetting stroke which is maintained until after the enlarged weld area has been shaved, the transition from phase to phase being smooth. By contrast, in prior-art machines the upsetting force is independent of the initial tension of the spring battery which generates it, and its development from an initial value to a peak value cannot be influenced. There it could be varied only through physical redesign of the device.

It will be understood that the claims are intended to cover all changes and modifications of the preferred embodiments of the invention, herein chosen for the purpose of illustration, which do not constitute departures from the spirit and scope of the invention.

What is claimed is:

1. A chain welding machine comprising:
(a) first and second upsetting dies;
(b) first means for rapidly moving said upsetting dies into abutment with opposed ends of a chain link to be welded;
(c) second means for applying upsetting force to said upsetting dies; and
(d) fluid-controlled means for varying said upsetting force during the welding of a chain link.

2. The chain welding machine recited in claim 1 wherein said fluid-controlled means is hydraulic controlled.

3. The chain welding machine recited in claim 1 wherein said fluid-controlled means comprises:
(a) a source of pressurized fluid;
(b) a disk cam;
(c) a pressure limiting valve connected to said pressurized fluid;
(d) a feeler roller connected to said pressure limiting valve and contacting said disk cam, said pressure limiting valve being effective to relieve the pressure of the pressurized fluid connected to it in proportion to the position of said feeler roller;
(e) a pressure regulating valve connected to said pressure limiting valve;
(f) a fluid-operated piston connected to said pressure regulating valve and applying force to said second means in proportion to the fluid pressure connected to it; and
(g) said disk cam being effective during the welding of a chain link to increase and decrease the force applied to said second means.

4. The chain welding machine recited in claim 1 wherein said second means applies said upsetting force through at least part of said first means.

5. The chain welding machine recited in claim 1 wherein said first means comprises:
(a) at least one cam;
(b) a lever actuated by said at least one cam;
(c) first and second knee lever legs pivotably connected together at first ends thereof;
(d) the second end of said first knee lever being pivotably connected to one of said upsetting dies;
(e) said lever being pivotably connected to the first ends of said first and second knee levers; and
(f) said cam being effective to move said lever between first and second operative positions, said first position moving said knee levers out of longitudinal alignment whereby the connected upsetting die is moved away from a chain link to be welded, and said second position moving said knee levers into longitudinal alignment whereby the connected upsetting die is moved toward a chain link to be welded.

6. The chain welding machine recited in claim 5 further comprising:
(a) the second end of said second knee lever being pivotably connected to said second means whereby said second means applies upsetting force to the connected upsetting die through said first and second knee levers in their longitudinally aligned positions.

7. A chain welding machine comprising:
(a) first and second upsetting dies for applying force to the ends of a chain link to be welded;
(b) first and second knee levers operatively connected to each upsetting die;
(c) cam-operated means for placing said knee levers in bent or straightened positions;
(d) upsetting levers linked to each said first and second knee levers, said upsetting levers being effective to apply upsetting force through their connected knee levers in straightened positions to their upsetting dies;
(e) a fluid actuated cylinder operatively connected to said upsetting levers; and
(f) variable means for connecting fluid pressure to said fluid actuated cylinder which varies in a predetermined manner during the cycle of welding a chain link.

8. Chain welding machine for the electric upset butt welding of the links, preformed into C-shape, of a chain strand comprising:

(a) a cam shaft;
(b) two upsetting dies which act upon two rounded portions of the chain link to be welded and which are movable relative to each other in opposite directions in controlled motion;
(c) at least one kinematic chain of elements beginning with a control lever and ending at a movable upsetting die;
(d) a hydraulic cylinder having a piston, said hydraulic cylinder serving as a link that is connected to at least one link of the kinematic chain of elements;
(e) an accumulator;
(f) a supply line for a hydraulic liquid connected to said hydraulic cylinder and discharging into the hydraulic cylinder;
(g) a pressure-regulating valve in the supply line;
(h) said hydraulic cylinder being effective to actuate said control lever;
(i) a pressure-limiting valve adapted to be mechanically actuated by a feeler roller which rolls along a disk cam mounted on the cam shaft; and
(j) said pressure-limiting valve being connected for preliminary control of said pressure-regulating valve.

9. Machine as defined in claim 8 further comprising:
(a) said hydraulic cylinder being single-acting;
(b) said hydraulic cylinder being jointed to the machine frame and to a jointing arm of the control lever;
(c) a roller mounting on said jointing arm of the control lever;
(d) a disk cam on said cam shaft cooperating with said roller during a fraction of the time of a single revolution of the cam shaft.

10. Machine as defined in claim 8 further comprising:
(a) a bypass line containing a bypass check valve bypassing said pressure-regulating valve which permits the return of the hydraulic liquid from the hydraulic cylinder to the accumulator.

11. Machine as defined in claim 8 further comprising:
(a) a safety relief valve connected to a hydraulic pump moving hydraulic liquid;
(b) said supply line being forked ahead of the pressure-regulating valve and having first and second branch lines, said first branch line being connected to the accumulator, said second branch line being connected to a safety pressure-limiting valve.

12. Machine as defined in claim 11 further comprising:
(a) said safety pressure-limiting valve being connected in parallel with the series-connected hydraulic pump and safety relief valve.

* * * * *